US006581848B1

(12) United States Patent
Plica

(10) Patent No.: US 6,581,848 B1
(45) Date of Patent: Jun. 24, 2003

(54) SLEEPER FRAME FOR A RAIL SYSTEM FOR RAIL-MOUNTED VEHICLES, ESPECIALLY FOR A BALLASTED TRACK

(76) Inventor: Peter Plica, Konigswieser Str. 87a, 81475 Munich (DE)

( * ) Notice: Subject to any disclaimer, the term of this patent is extended or adjusted under 35 U.S.C. 154(b) by 0 days.

(21) Appl. No.: 09/787,463

(22) PCT Filed: Sep. 16, 1999

(86) PCT No.: PCT/DE99/02954

§ 371 (c)(1),
(2), (4) Date: Aug. 13, 2001

(87) PCT Pub. No.: WO00/15908

PCT Pub. Date: Mar. 23, 2000

(30) Foreign Application Priority Data

Sep. 16, 1998 (DE) ..... 198 42 312
Apr. 16, 1999 (DE) ..... 198 17 179

(51) Int. Cl.[7] ..... E01B 29/06
(52) U.S. Cl. ..... 238/27; 238/264
(58) Field of Search ..... 238/29, 30, 24, 238/25, 27, 289, 292, 264, 35

(56) References Cited

U.S. PATENT DOCUMENTS 1,410,185 A * 3/1922 Ickes ..... 238/29
1,585,419 A * 5/1926 Ruse ..... 238/29
2,439,593 A * 4/1948 Young ..... 238/188

* cited by examiner

*Primary Examiner*—S. Joseph Morano
*Assistant Examiner*—Robert J. McCarry, Jr.
(74) *Attorney, Agent, or Firm*—Shaffer & Culbertson, LLP

(57) ABSTRACT

The invention relates to a sleeper frame for a track system for railborne vehicles, particularly for a ballasted track, consisting of several cross-ties (1) provided in the direction transverse to the track, and one or several longitudinal supports (2) connected with the cross-ties, wherein one cross-tie (1), respectively, substantially forms the outer delimitation of the sleeper frame in the longitudinal direction, with outer bearings (4) and fixtures (3) for the rails (6) being provided on the outer cross-ties, and with a continuous or quasi-continuous bearing for the rails (6) being provided between the outer rail bearings (4).

20 Claims, 1 Drawing Sheet

SLEEPER FRAME FOR A RAIL SYSTEM FOR RAIL-MOUNTED VEHICLES, ESPECIALLY FOR A BALLASTED TRACK

TECHNICAL FIELD OF THE INVENTION

The invention relates to a sleeper or support frame for a track system for railborne vehicles, particularly for a ballasted track.

BACKGROUND OF THE INVENTION

A rail system sleeper frame having cross-ties interconnected with longitudinal supports is shown in the document CH 545 376. Contrasting to the ballasted track with cross-ties commonly used, sleeper frames have the advantage that they rest in the ballast more uniformly, that the ballast is subjected to less compressive forces under the wheel loads, and that they have an increased resistance to crosswise displacement.

The increased length of the sleeper frames in the longitudinal direction of the track, however, also leads to some disadvantages. One such disadvantage relates to the connections forming the transverse joints. In order to avoid detrimental movements of the transverse joints between the sleeper frames, the joints have to be connected by force-locking. Also, because of the little deformations of the frame in the ballast, the required elastic subsidence of the rail in the vertical direction under the wheel rolling over it makes highly elastic bearing or support constructions between the rail and the sleeper frame necessary, which, on the other hand, also promote the undesired tilting of the rail in the rail fixture. Furthermore, the regular and comparatively small distance of cross-ties and rail fixtures in the longitudinal direction of the track leads to vibrations in the ballast under the load of rolling wheels, which worsen the stability of the ballasted track considerably.

The disadvantages of this constructions are primarily the great technical and economic efforts required for the connection of the joints.

Furthermore, a permanent way is known from the document AT-PS 377 806 in which individual frame elements are arranged in a row, with each rail resting on one frame element by means of several bearings. The frame elements may be connected at their faces by means of plugs in order to absorb larger transverse forces. These elements manufactured in the style of prestressed concrete are reinforced by prestressing elements which extend in a straight line between two opposite faces of the element, respectively.

This construction has the disadvantage that, for absorbing large transverse forces, it is necessary to connect the frame elements, as well, which involves corresponding efforts regarding the manufacture and the assembly thereof. Furthermore, as a result of the relatively large distance of the rail bearings within one element, vibrations are caused when the load of the wheel of a railborne vehicle acts on the rail, because the bending behaviour of the rail varies. Manufacturing the element as a prestressed concrete part with reinforcement elements extending in the longitudinal and the transverse directions, respectively, makes prestressing in two directions perpendicular to each other necessary. This leads to considerable efforts in the manufacturing process, too.

SUMMARY OF THE INVENTION

The object of the present invention is to provide a sleeper frame for a track system for railborne vehicles, particularly for a ballasted track, in which it is not necessary even in case of large transverse forces to provide any large-scale connections of the sleeper frames in the transverse joints or any highly elastic rail bearings in the area of the rail fixtures, and which makes it possible to reduce the frequency of the vibrations generated in the railborne vehicle. Furthermore, it is intended to provide a simple and cost-efficient method of manufacturing sleeper frames of this kind.

The particular advantages of the sleeper frame according to the invention consist in that, on the one hand, the rail fixtures positioned outside on the edge of the frame reduce the vertical gaps in the transverse joint to such an extent that a connection between the sleeper frames can be dispensed with; on the other hand, the distance between the rail fixtures is made substantially larger thereby, which has the consequence that the frequency of vibrations is reduced correspondingly.

According to an embodiment of the invention, the outer rail bearings exhibit a large stiffness in the area of the rail fixtures and the intermediate rail bearing exhibits little, or relatively less stiffness, with the bearing surface of the intermediate rail bearing in a relaxed condition lying markedly higher than that of the outer rail bearings before the rail has been mounted, so, when the rail fixtures are tightened to secure the rail, the intermediate rail bearing is pressed down to the height of the outer rail bearings and is thus precompressed.

This results in the advantage that what is referred to as the lifting wave of the rail, which is encountered behind a wheel of the railborne vehicle in the direction of motion, is nevertheless supported by the intermediate bearing, so the rail is not lifted off the bearing in the area of the lifting wave. The damping effect of the elastic intermediate bearing is maintained.

According to another embodiment of the invention, an elastic material, preferably an elastic mat, is provided at the underside of the cross-ties and/or the longitudinal supports.

By this, it is achieved that the elastic mat arranged beneath the sleeper frame takes over the required vertical subsidence of the rail to a large extent, so the rail can be fixedly connected with the sleeper frame and can be protected from tilting with the aid of the stiff outer rail bearings. Owing to the soft intermediate rail bearing, the vertical rail deformation between the rail fixtures remains almost unimpeded.

The precompression in the intermediate rail bearing can be adjusted depending on its stiffness and the height of precompression in such a way that the vertical subsidence of the rail under the load of a wheel becomes equally large both in the middle of the frame and in the rail fixtures and thus corresponds to a continuous rail bearing. This also further improves the damping of vibrations of the system.

According to a different embodiment of the invention, a longitudinal support is provided under one rail axis, respectively. Hereby, a continuous or quasi-continuous bearing for the rail can easily be achieved without having to arrange the cross-ties very close to one another, for example. In particular, the number of cross-ties can be reduced to two. On this occasion, it is to be remarked that a quasi-continuous bearing of the rail means a bearing thereof in points or portions arranged close to one another, without a substantial deviation from the desired bending curve of the rail under load being created in the portions in which no bearing is provided.

The position of the outer rail bearings and/or the rail fixtures is selected such that the mid-plane of the rail fixtures transverse to the extension or longitudinal axis of the rails is spaced from the outer delimitation or nearest longitudinal end of the sleeper frame by a distance of ≦15 cm, preferably ≦10 cm in the longitudinal direction. Provided that the cross-ties have a corresponding dimension in the longitudinal direction, it is possible to arrange these elements in the middle of the cross-ties relative to this dimension, that is, the rail fixtures may be placed on the longitudinal center axis of the cross-ties.

According to the preferred embodiment of the invention, the cross-ties and the at least one longitudinal support are integrally formed, preferably as an element of prestressed concrete. Thus, simple and efficient manufacture is possible.

The sleeper frame as a whole may be configured as a part of prestressed concrete, or outer portions of the cross-ties (and, as the case may be, the longitudinal supports) manufactured as normal concrete parts or parts of prestressed concrete may be connected with a connecting rod in the form of a metal section.

According to an embodiment of the invention, prestressing elements are used as a reinforcement of the sleeper frame, which are anchored at the faces of a cross-tie. The prestressing elements are guided from this cross-tie via a longitudinal support to a second cross-tie using arcs and are anchored at the faces of this second cross-tie. This has the advantage that prestressing can be effected from merely two opposite sides of the frame and that this prestressing can be effected both in the longitudinal and in the transverse direction in one step.

Here, at least two U-shaped prestressing elements rotated by 180° relative to each other may be provided, whose ends are anchored at opposite faces of two cross-ties, respectively. The arcs of the prestressing elements may extend through the same longitudinal support or, in case of two or more longitudinal supports, through one longitudinal support, respectively, which is closer to those faces of the cross-ties in which the ends of the respective other prestressing element are anchored.

However, the prestressing elements may also be configured to be substantially Z-shaped, with the ends of one prestressing element being anchored at respective opposite ends of different cross-ties. In a sleeper frame which comprises at least two longitudinal supports, at least four Z-shaped prestressing elements may be provided, with two Z-shaped prestressing elements intersecting in the same longitudinal support, respectively.

For producing a sleeper frame of this kind, this sleeper frame may first be manufactured with prestressing joints in the longitudinal supports. The prestressing elements are then prestressed by widening the prestressing joints. Finally, the prestressing joints are closed with a suitable hardenable building material so that a positive and a non-positive connection is obtained in the prestressing joints. Of course, another suitable type of fixing of the prestressed position of the sleeper frame may be employed, too.

These features relating to the specific reinforcement of the sleeper frame and the prestressing method may of course also be used independently of the features relating to the positioning of the rail fixture and the configuration of the bearings. In this way, conventional sleeper frames consisting of at least two cross-ties and one or several longitudinal supports may be manufactured easily and cost-efficiently, too.

These and other objects, advantages, and features of the invention will be apparent from the following description of the preferred embodiments, considered along with the accompanying drawings.

DESCRIPTION OF THE PREFERRED EMBODIMENTS

Figure 1:
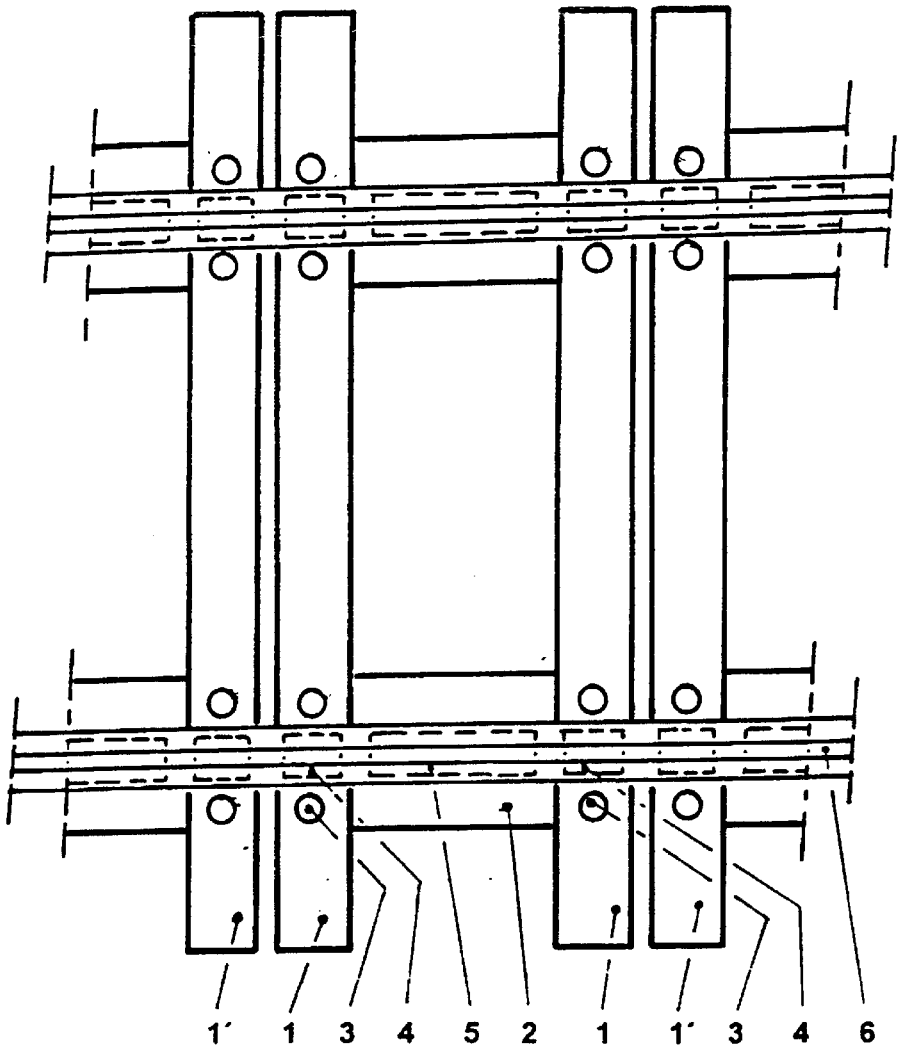
FIG. 1 shows a partial schematic plan view of a track system including a sleeper frame according to the invention.

The partial schematic plan view of a track system in FIG. 1 shows an embodiment of a sleeper frame with two (i.e. first and second) cross-ties 1, which are connected with two laterally spaced apart longitudinal supports 2 to form a preferably integral component. Each cross-tie 1 includes two outer rail bearing 4 and fail fixture 3 sets, one set for each rail 6 to be received. A first outer rail bearing 4 and rail fixture 3 set is located on the first cross-tie I and a second outer rail bearing 4 and rail fixture 3 set is located on the second cross-tie 1 for each respective rail to be received. The configuration of rail fixtures 3 with outer rail bearings 4 belonging thereto corresponds to known prior art.

By arranging the rail fixtures 3 on the cross-ties forming the outer delimitation of the sleeper frame, it is achieved that adjacent sleeper frames can be arranged in a row with only a relatively small gap between them, so the rails 6 can be fixed at the interfaces between two sleeper frames with only a small distance between them. Hereby, the absorption of transverse forces, particularly of forces acting in a vertical direction to the extension of the rails when they are subjected to a load by the wheels of a railborne vehicle is improved (of course, transverse forces also occur to a lesser extent in the plane formed by the rails 6, too, e.g. in curves). Thus, when the rails are subjected to a load, the practically inevitable bending at the interfaces of adjacent sleeper frames deviates from the desired value to a lesser extent.

Limiting the size of the frame in the longitudinal direction of the track to only two rail fixtures 3 arranged next to the transverse joint with the two outer rail bearings 4 is advantageous in that the frames can easily follow the subsidence of the rails occurring under the load of a wheel and that only minor differences in subsidence appear at the transverse joints. By this, the transverse forces to be transmitted in the transverse joint, too, remain so small that they are transmitted via the rails 6 without any substantial additional stress. Thus, an additional connection in the transverse joint is not necessary any more.

The intermediate rail bearing 5 between the outer rail bearings 4 has the function of vertically supporting the rail 6, which would otherwise be unsupported over a larger distance than usual, against the wheel loads and of dampening vibrations in the rail 6.

As the rail 6 is bent in two directions between the outer rail bearings 4 in the center of the frame, namely, downwards as a result of the wheel load directly on top of it and upwards as a result of the so-called lifting wave, the intermediate rail bearing 5 has to be capable of following these movements without being separated from the rail 6.

This is achieved by the fact that the surface of the intermediate rail bearing 5 lies in a markedly higher plane, preferably between 2 to 5 mm higher, than the surface of the outer rail bearings 4 before the rail is mounted, that is, when the intermediate rail bearing 5 is in its relaxed condition. As used herein, lying in a "higher plane" means that the distance between the bearing surface plane of the intermediate bearing 5 and the plane of the cross-ties 1 is relatively greater than the distance between the bearing surface plane of the outer rail bearings 4 and the plane of the cross-ties 1.

When the rail 6 is placed on the frame and the elastic rail fixtures 3 are tightened, the intermediate rail bearing 5 is pressed down to the height of the outer rail bearing 4 and is thus precompressed, with the precompression being maintained even in the case in which the rail is bent upwards by 0.1 mm.

The effect of the intermediate rail bearing 5 described here is particularly useful in case of large measuring tolerances in the gap between the rail 6 and the longitudinal support 2.

The distance between the individual sleeper frames, i.e. between the outer cross-ties 1 and 1' arranged close to one another, is to be as small as possible. On the one hand, a varying gap width is necessary when the rails are laid in curves; on the other hand, the process of laying may not be impeded by individual ballast stones in the gap. In this respect, a distance of 5 cm appears suitable.

Figure 2:
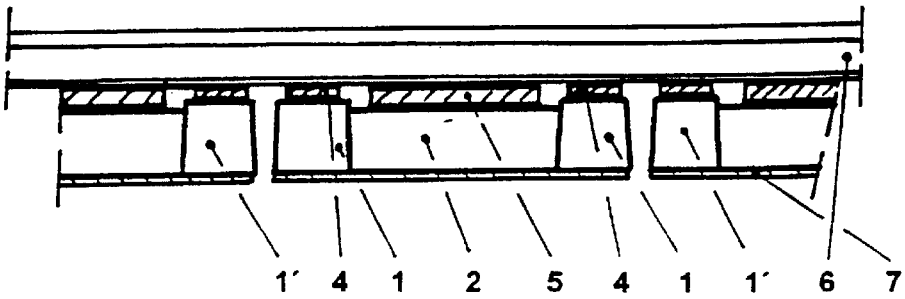
FIG. 2 shows a side view of the illustration in FIG. 1.

According to another embodiment of the invention, an elastic material, preferably an elastic mat, is provided at the underside of the cross-ties 1 and/or the longitudinal supports 2. This elastic mat is shown at reference numeral 7 in FIG. 2.

The above described preferred embodiments are intended to illustrate the principles of the invention, but not to limit the scope of the invention. Various other embodiments and modifications to these preferred embodiments may be made by those skilled in the art without departing from the scope of the following claims.

What is claimed is:

1. A sleeper frame for a track system for railborne vehicles, the sleeper frame being adapted to be aligned end-to-end with additional such frames to provide substantially continuous support for rails associated with the track system, the sleeper frame including:

(a) at least one longitudinal support;

(b) a first cross-tie connected to each longitudinal support to form an outer delimitation at a first longitudinal end of the sleeper frame;

(c) a second cross-tie connected to each longitudinal support to form an outer delimitation at a second longitudinal end of the sleeper frame opposite the first longitudinal end;

(d) a first outer rail bearing and rail fixture set mounted on the first cross-tie and a second outer rail bearing and rail fixture set mounted on the second cross-tie for each rail to be supported on the sleeper frame; and (e) a continuous or quasi-continuous intermediate bearing for each rail to be supported on the sleeper frame, each respective intermediate bearing being supported on the sleeper frame between the first outer rail bearing and rail fixture set and second outer rail bearing and rail fixture set for the respective rail.

2. The sleeper frame of claim 1 wherein:

(a) the first outer rail and second outer rail bearing each exhibits a large stiffness adjacent to the respective rail fixture;

(b) each intermediate bearing exhibits relatively less stiffness than the first outer rail bearing and second outer rail bearing between which the respective intermediate bearing is positioned; and (c) a bearing surface of each respective intermediate bearing lies in a plane markedly higher than a bearing plane of the outer rail bearings when no rail is mounted over the respective intermediate bearing and respective first and second outer rail bearings, such that when a rail is connected to the respective rail fixtures the intermediate rail bearing between said rail fixtures is compressed down to the height of the first and second outer rail bearings associated with said rail fixtures.

3. The sleeper frame of claim 1 wherein an elastic material is provided at the underside of each longitudinal support or at the underside of the first cross-tie and second cross-tie.

4. The sleeper frame of claim 1 including one longitudinal support for each rail to be supported by the sleeper frame.

5. The sleeper frame of claim 1 wherein each first outer rail bearing and rail fixture set and each second outer rail bearing and rail fixture set is mounted on a longitudinal center axis of the respective cross-tie.

6. The sleeper frame of claim 1 wherein the mid-plane of each respective rail fixture transverse to a longitudinal axis of the sleeper frame is spaced from the nearest outer delimitation of said sleeper frame by a distance no greater than 15 centimeters.

7. The sleeper frame of claim 1 wherein the first cross-tie and second cross-tie are integrally formed with each longitudinal support.

8. The sleeper frame of claim 7 wherein the first cross-tie, second cross-tie, and each longitudinal support are formed from reinforced concrete and a mid-portion of each cross-tie comprises a steel connecting rod.

9. A sleeper frame for a track system for railborne vehicles, the sleeper frame being adapted to be aligned end-to-end with additional such frames to provide substantially continuous support for rails associated with the track system, the sleeper frame including:

(a) two laterally spaced apart longitudinal supports extending substantially parallel to a longitudinal axis of the sleeper frame;

(b) a first cross-tie transversely connected to each longitudinal support to form a first longitudinal end of the sleeper frame;

(c) a second cross-tie transversely connected to each longitudinal support to form a second longitudinal end of the sleeper frame opposite the first longitudinal end;

(d) for each rail to be supported on the sleeper frame, a first outer rail bearing and rail fixture set mounted on the first cross-tie and a second outer rail bearing and rail fixture set mounted on the second cross-tie; and (e) an intermediate bearing for each rail to be supported on the sleeper frame, each respective intermediate bearing being supported on the sleeper frame between the first outer rail bearing and rail fixture set and the second outer rail bearing and rail fixture set for the respective rail, and wherein (f) each intermediate bearing exhibits relatively less stiffness than the first and second outer rail bearings between which the respective intermediate bearing is supported; and (g) when each respective intermediate bearing is in a relaxed condition, a bearing surface of the respective intermediate bearing lies in a plane higher than a bearing plane of the first and second outer rail bearings between which the respective intermediate bearing is supported.

10. The sleeper frame of claim 9 wherein an elastic material is provided at the underside of each longitudinal support or at the underside of the first cross-tie and second cross-tie.

11. The sleeper frame of claim 9 wherein each outer rail bearing and rail fixture set is mounted on a longitudinal center axis of the respective cross-tie.

12. The sleeper frame of claim 9 wherein the mid-plane of each rail fixture transverse to the longitudinal axis of the sleeper frame is spaced from the respective nearest end of said sleeper frame by a distance no greater than 15 centimeters.

13. The sleeper frame of claim 9 wherein the first cross-tie and second cross-tie are integrally formed with each longitudinal support.

14. The sleeper frame of claim 13 wherein the first cross-tie, second cross-tie, and each longitudinal support are formed from reinforced concrete and a mid-portion of each cross-tie comprises a steel connecting rod.

15. A track system for railborne vehicles, the track system including:

(a) a plurality of sleeper frames;

(b) each sleeper frame including:

(i) two laterally spaced apart longitudinal supports extending substantially parallel to a longitudinal axis of the respective sleeper frame;

(ii) a first cross-tie transversely connected to each longitudinal support at a first longitudinal end of the respective sleeper frame;

(iii) a second cross-tie transversely connected to each longitudinal support at a second longitudinal end of the respective sleeper frame opposite the first longitudinal end;

(iv) for each rail to be supported on the respective sleeper frame, a first outer rail bearing and rail fixture set mounted on the first cross-tie and a second outer rail bearing and rail fixture set mounted on the second cross-tie; and (v) an intermediate bearing for each rail to be supported on the respective sleeper frame, each respective intermediate bearing being supported on the respective sleeper frame between the first outer rail bearing and rail fixture set and the second outer rail bearing and rail fixture set for the respective rail; and (c) the plurality of sleeper frames being arranged so that each longitudinal end of each respective sleeper frame is aligned with and lies adjacent to either the first or second longitudinal end of a next adjacent one of the sleeper frames.

16. The track system of claim 15 wherein:

(a) each intermediate bearing exhibits relatively less stiffness than the first and second outer rail bearings between which the respective intermediate bearing is supported; and (b) when each respective intermediate bearing is in a relaxed condition, a bearing surface of the respective intermediate bearing lies in a plane higher than a bearing plane of the first and second outer rail bearings between which the respective intermediate bearing is supported.

17. The track system of claim 15 wherein and elastic material is provided at the underside of each longitudinal support or at the under side of the first cross-tie and second cross-tie.

18. The track system of claim 15 wherein each outer rail bearing and rail fixture set is mounted on a longitudinal center axis of the respective cross-tie.

19. The track system of claim 15 wherein the mid-plane of each rail fixture transverse to the longitudinal axis of the respective sleeper frame is spaced from the respective nearest end of said sleeper frame by a distance no greater than 15 centimeters.

20. The track system of claim 15 wherein the first cross-tie and second cross-tie for each respective sleeper frame are integrally formed with each longitudinal support for the respective sleeper frame.

* * * * *

UNITED STATES PATENT AND TRADEMARK OFFICE

CERTIFICATE OF CORRECTION

PATENT NO. : 6,581,848 B1
DATED : June 24, 2003
INVENTOR(S) : Peter Plica

It is certified that error appears in the above-identified patent and that said Letters Patent is hereby corrected as shown below:

Column 4,
Line 14, delete “fail” and insert -- rail --.

Column 8,
Line 18, delete “and” and insert -- an --.

Signed and Sealed this

Nineteenth Day of August, 2003

JAMES E. ROGAN
*Director of the United States Patent and Trademark Office*